US008875925B2

(12) United States Patent
Melzer

(10) Patent No.: US 8,875,925 B2
(45) Date of Patent: Nov. 4, 2014

(54) TEACUP COVER

(75) Inventor: Brian Melzer, Delray Beach, FL (US)

(73) Assignee: Epoca International, Inc., Boca Raton, FL (US)

( * ) Notice: Subject to any disclaimer, the term of this patent is extended or adjusted under 35 U.S.C. 154(b) by 275 days.

(21) Appl. No.: 13/075,829

(22) Filed: Mar. 30, 2011

(65) Prior Publication Data

US 2012/0132651 A1 May 31, 2012

Related U.S. Application Data

(63) Continuation-in-part of application No. 29/379,998, filed on Nov. 29, 2010, now Pat. No. Des. 653,076.

(51) Int. Cl.

| | |
|---|---|
| ***B65D 41/56*** | (2006.01) |
| ***B65D 55/02*** | (2006.01) |
| ***B65B 29/02*** | (2006.01) |
| ***A47G 19/14*** | (2006.01) |
| ***A47G 19/22*** | (2006.01) |
| ***A47G 21/10*** | (2006.01) |

(52) U.S. Cl.

CPC ..... *A47G 19/14* (2013.01); *A47G 19/22* (2013.01); *A47G 21/106* (2013.01)

USPC ..... 220/212; 426/77; 215/227

(58) Field of Classification Search

USPC ..... 220/212, 212.5, 287, 305, 574.1, 220/592.21, 592.28, 369, 703, 71, 0.5, 711, 220/715, 713, 729, 735, 736, 592.17, 697; 215/227, 228, 298, 390, 391; 426/77, 426/435; 99/279; 206/0.5

See application file for complete search history.

(56) References Cited

U.S. PATENT DOCUMENTS

| | | | | |
|---|---|---|---|---|
| D167,600 | S | 8/1952 | Waters | |
| 2,800,408 | A * | 7/1957 | Fimple | 426/80 |
| 3,326,363 | A * | 6/1967 | Bennett et al. | 206/219 |
| 3,529,744 | A * | 9/1970 | Edwards et al. | 220/212.5 |
| 4,183,444 | A * | 1/1980 | English et al. | 220/200 |
| 4,394,928 | A * | 7/1983 | Philip | 220/373 |

(Continued)

FOREIGN PATENT DOCUMENTS

| | | |
|---|---|---|
| DE | 37 29 018 A1 | 3/1989 |
| DE | 297 15 610 U1 | 11/1997 |

(Continued)

OTHER PUBLICATIONS

Communication and extended European Search Report from European Patent Application No. 11164317.7, dated Aug. 23, 2011 (7 pages).

(Continued)

*Primary Examiner* — Bryon Gehman
*Assistant Examiner* — Shawn M Braden
(74) *Attorney, Agent, or Firm* — Akerman LLP

(57) ABSTRACT

Disclosed herein is an improved cup cover that includes a base having a slit extending from an edge, and a protrusion extending from the base. The slit can be configured to receive a string associated with a teabag. The protrusion can be divided into a first half and a second half by a through-slot which may be configured to receive the string associated with the teabag. The first half and the second half of the protrusion may be configured to releaseably secure the string associated with the teabag therebetween.

15 Claims, 12 Drawing Sheets

(56) References Cited

U.S. PATENT DOCUMENTS

| | | | | |
|---|---|---|---|---|
| 5,166,719 | A | 11/1992 | Chinzei et al. | |
| 5,636,923 | A | 6/1997 | Nejat-Bina | |
| D404,253 | S | 1/1999 | Littmann | |
| 6,460,725 | B1 * | 10/2002 | Portman et al. | 220/713 |
| D497,282 | S | 10/2004 | Kelly et al. | |
| D511,434 | S | 11/2005 | Feil | |
| 6,976,578 | B1 * | 12/2005 | Kenihan | 206/222 |
| D550,030 | S | 9/2007 | Peterson | |
| D567,017 | S | 4/2008 | Garman et al. | |
| D576,837 | S | 9/2008 | Le Vavasseure | |
| 7,913,867 | B2 * | 3/2011 | Phillips | 220/254.2 |
| 2005/0183579 | A1 * | 8/2005 | Bowers | 99/279 |

FOREIGN PATENT DOCUMENTS

| | | | |
|---|---|---|---|
| DE | 20 2004 003353 | U1 | 5/2004 |
| GB | 2 281 852 | A | 3/1995 |
| GB | 2 368 333 | A | 5/2002 |
| WO | WO 2009/134062 | A2 | 11/2009 |

OTHER PUBLICATIONS

Notice of Allowance mailed Sep. 26, 2011 from U.S. Appl. No. 29/379,998 (8 pages).

T-Squeeze—Model Number: T-SQ, product description printout from http://www.evriholder.com/T-Squeeze.asp, copyright 2010 (3 pages).

U.S. Appl. No. 29/379,998 entitled: "Teacup Cover," filed Nov. 29, 2010 (8 pages).

* cited by examiner

TEACUP COVER

CROSS-REFERENCE TO RELATED APPLICATION

This application claims priority to and is a continuation-in-part application of U.S. patent application Ser. No. 29/379,998, filed on Nov. 29, 2010, now U.S. Pat. No. D,653,076 the disclosure of which is herein incorporated by reference in its entirety.

FIELD OF THE INVENTION

The present invention relates generally to a teacup cover, and, more specifically, to a teacup cover for holding and securing a teabag string, and for facilitating squeezing liquid from a teabag after use.

BACKGROUND OF THE INVENTION

When drinking tea, a teabag is placed within the hot liquid contained within the teacup, and a string and tag attached to the teabag can be used to bob the teabag in and out of the hot liquid, or the string and tag can be draped over the teacup edge, leaving the teabag in the teacup. The purpose of the string and tag is to allow the drinker to easily bob and/or remove the teabag in/from the hot liquid without having to scoop the teabag out with a spoon. However, the teabag often sinks to the bottom of the teacup and pulls the string and tag into the water, leaving the drinker helpless and unable to bob the teabag in the water or remove the teabag without using a spoon.

Once a drinker does remove the teabag from the teacup, after determining that it has been properly steeped, there is often an attempt to squeeze the remaining liquid out of the teabag and into the cup. A common approach is that the teabag is pressed against the inside of the cup by a spoon, or is held on a spoon while the string is wrapped around the teabag and the spoon. However, both of these approaches are generally inadequate and difficult to perform; often resulting in liquid being spilled.

Once the majority of the liquid has been extracted from the teabag, the drinker faces the problem of disposing the teabag. In many instances, this involves placing the teabag on a plate or elsewhere, allowing the remaining liquid to leak out of the teabag and creating potential for a further mess.

Accordingly, it is an object of the present invention to overcome one or more of the above-described drawbacks and/or disadvantages of the prior art.

SUMMARY OF THE INVENTION

The present invention overcomes the disadvantages and shortcomings of the prior art by providing an improved cup cover.

In preferred embodiments, the cup cover comprises a base having a first slit extending from an edge of the base toward a center of the base; and a protrusion extending from the base, the first slit is configured to receive a string, the protrusion is divided into a first half and a second half by a through-slot, the through-slot is configured to receive the string, and the first half and the second half secure the string therebetween.

One advantage of the present invention is that it provides a cup cover which can secure the string of a teabag. Another advantage is that the cup cover can be used to squeeze liquid from a teabag into the teacup. Yet another advantage is that the cup cover can retain excess liquid that may drip from the teabag.

Other objects and advantages of the present invention and/or of the currently preferred embodiments thereof will become more readily apparent in view of the following detailed description and accompanying drawings.

BRIEF DESCRIPTION OF THE DRAWINGS

For a complete understanding of the present invention, reference is made to the following detailed description of an exemplary embodiment considered in conjunction with the accompanying drawings, in which.

DETAILED DESCRIPTION OF THE INVENTION

Figure 1:
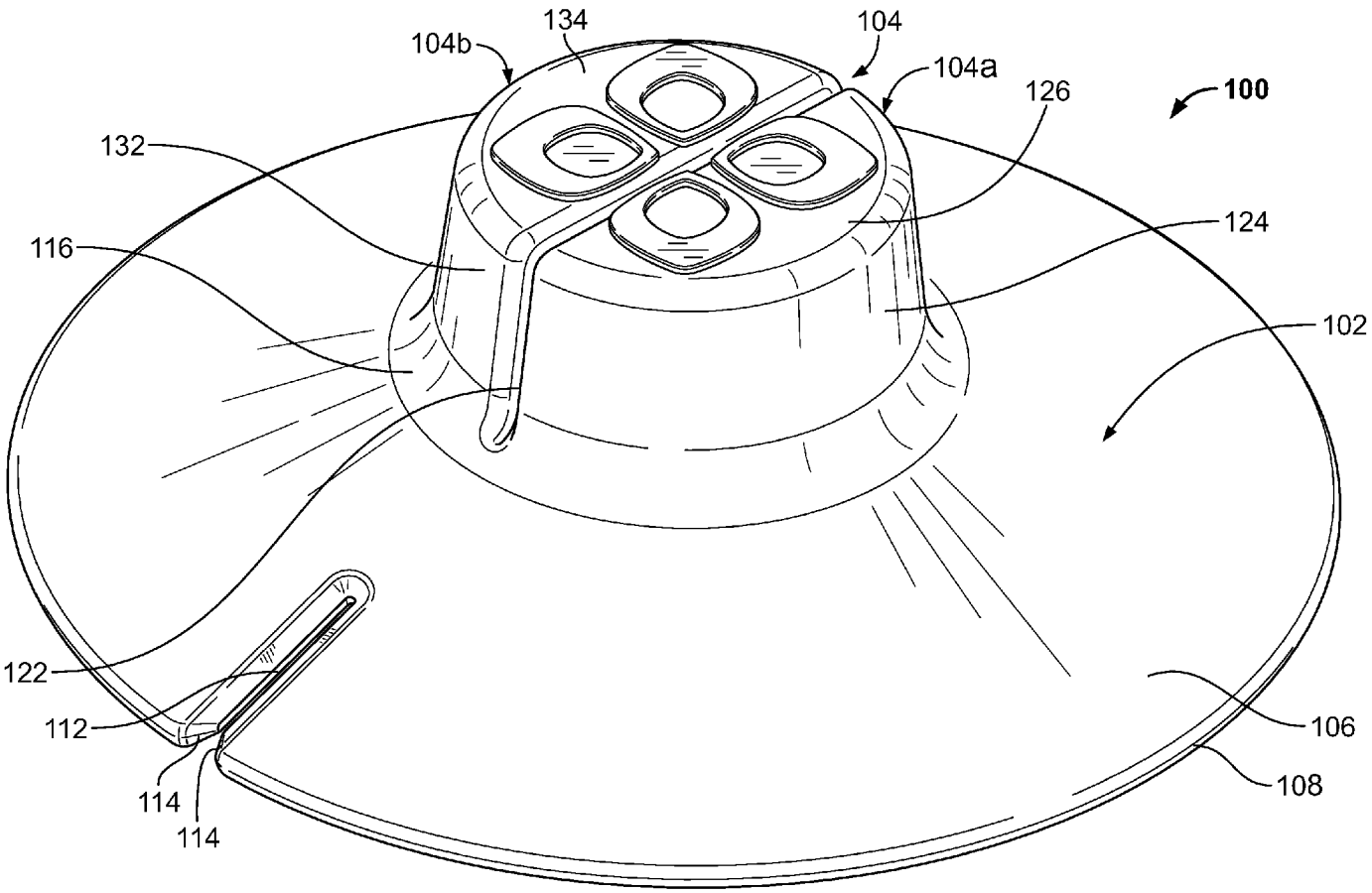
FIG. 1 is a top perspective view of the teacup cover of the present invention.

Referring to FIGS. 1-9, a teacup cover 100 is shown in accordance with an exemplary embodiment of the present invention. The teacup cover 100 includes a base 102 and a divided protrusion 104, which is separated into a first protrusion half 104*a* and a second protrusion half 104*b*, each of which will be discussed below in detail.

In the embodiment of FIGS. 1-9, the base 102 comprises a top surface 106, an edge 108, a bottom surface 110, a radial slit 112, and a fillet 116. The teacup cover 100 is generally monolithic in form including the base 102, which generally slopes downward, with a frustoconical shape, from the fillet 116 toward the edge 108. The base 102 is substantially circular in shape and sized to have a diameter larger than a standard teacup diameter; however, it should be understood that the base 102 can have varying shapes and sizes. For example, the base 102 can be square shaped, diamond shaped, star shaped, or any other geometric figure, while the diameter, or size, of the base 102, can be designed to match and accommodate cups of varying sizes. Having a diameter larger than a standard teacup diameter allows the teacup cover 100 to be placed on a teacup such that the entire top of the teacup is covered, thus allowing the teacup cover 100 to securely sit on top of the teacup. When placed on a teacup, the bottom surface 110 acts to engage the top of the teacup.

The radial slit 112 extends from the edge 108 radially inward toward the center of the base 102. Specifically, the radial slit 112 extends through the base 102, from the top surface 106 to the bottom surface 110 thereof, which allows an object, e.g., a teabag string, to extend through the base 102. In some embodiments, the radial slit 112 extends inward approximately ¾ of an inch and is a few millimeters wide. The radial slit 112 is configured to accommodate a teabag string. The teabag string can be inserted into the radial slit 112 whereby the teabag is below the base 102 while a portion of the teabag string is above the base 102. Thus, the teabag string can extend through the base 102. In some embodiments, the radial slit 112 includes a plurality of chamfered edges 114 connecting the edge 108 with the radial slit 112. The chamfered edges 114 provide an opening towards the radial slit 112 to facilitate inserting a teabag string into the radial slit 112.

The divided protrusion 104 extends from the central portion of the base 102, and the divided protrusion 104 is connected to the base 102 by the fillet 116. Preferably, the divided protrusion 104 and the base 102 are monolithically formed as a single unit. The divided protrusion 104 generally acts as a handle for the teacup cover 100, facilitating handling of the teacup cover 100. Specifically, the divided protrusion 104 can be grasped to place the teacup cover 100 on a teacup or to remove the teacup cover 100 from a teacup. The divided protrusion 104 is generally cylindrical in shape and separated into a first protrusion half 104*a* and a second protrusion half 104*b*. The first protrusion half 104*a* and the second protrusion half 104*b* are generally half-cylindrical in shape and are separated by a through-slot 122. In the exemplary embodiment, the first protrusion half 104*a* and the second protrusion half 104*b* are mirrored structures, and, as such, have identical and matching elements. However, it should be recognized by those of ordinary skill in the art, that the first protrusion half 104*a* and the second protrusion half 104*b* do not have to be identical structures but may each have their own respective design based on a particular use or need. For example, the first protrusion half 104*a* may be contoured to include a singular imprint, while the second protrusion half 104*b* may be contoured to include multiple imprints which would facilitate in gripping the divided protrusion 104. The top of the divided protrusion 104 could include indicia or a design.

Figure 2:
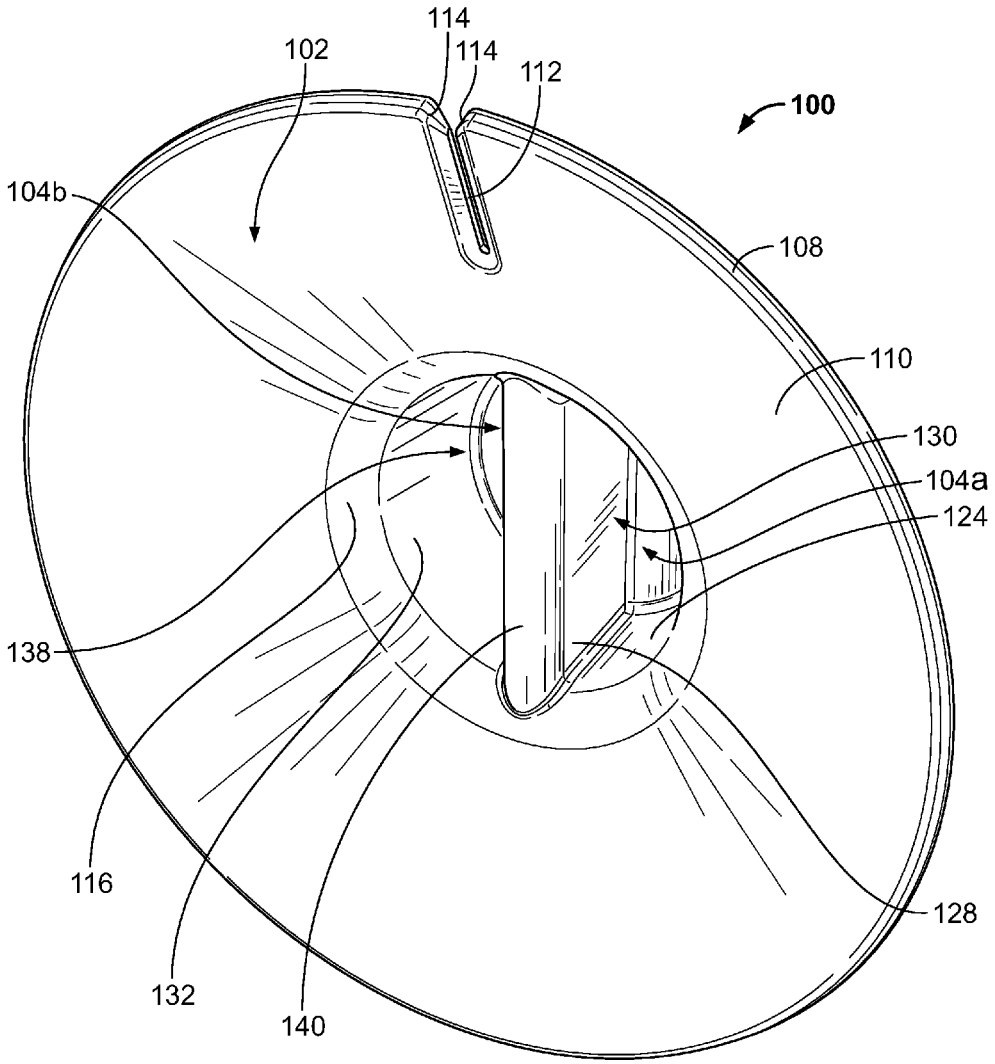
FIG. 2 is a bottom perspective view of the teacup cover of the present invention.
Figure 3:
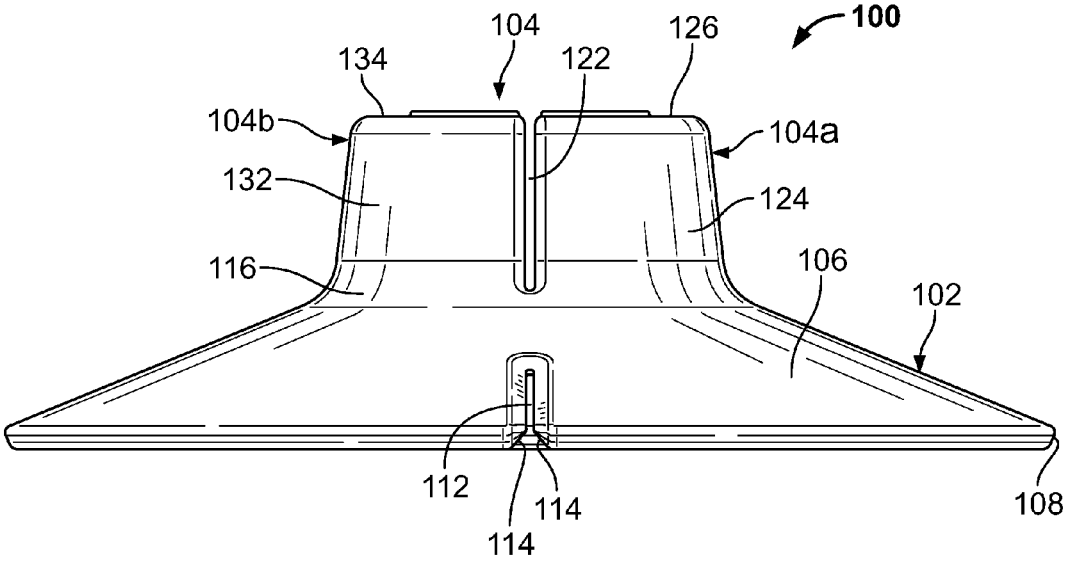
FIG. 3 is a front elevational view of the teacup cover of FIGS. 1 and 2.
Figure 4:
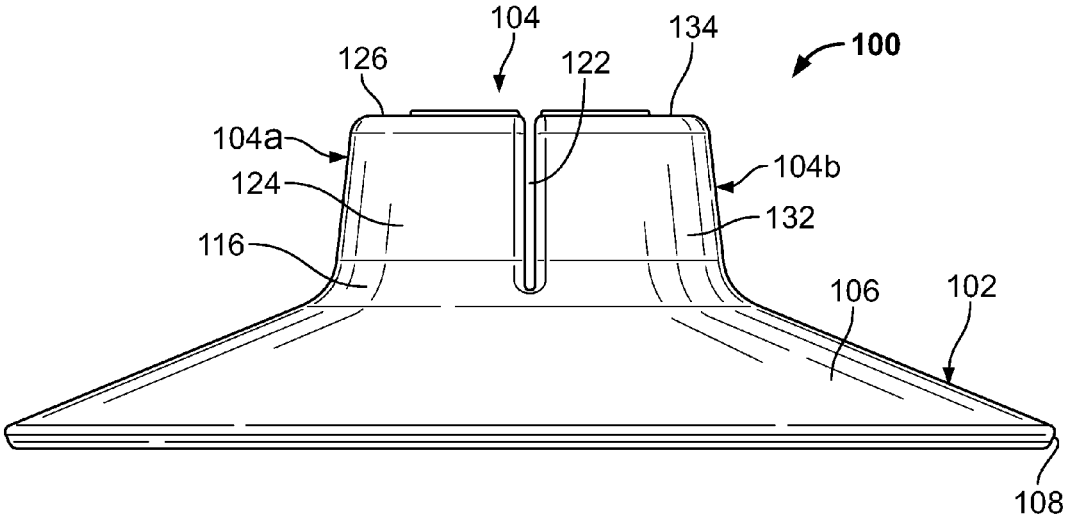
FIG. 4 is a rear elevational view of the teacup cover of FIGS. 1 and 2.
Figure 5:
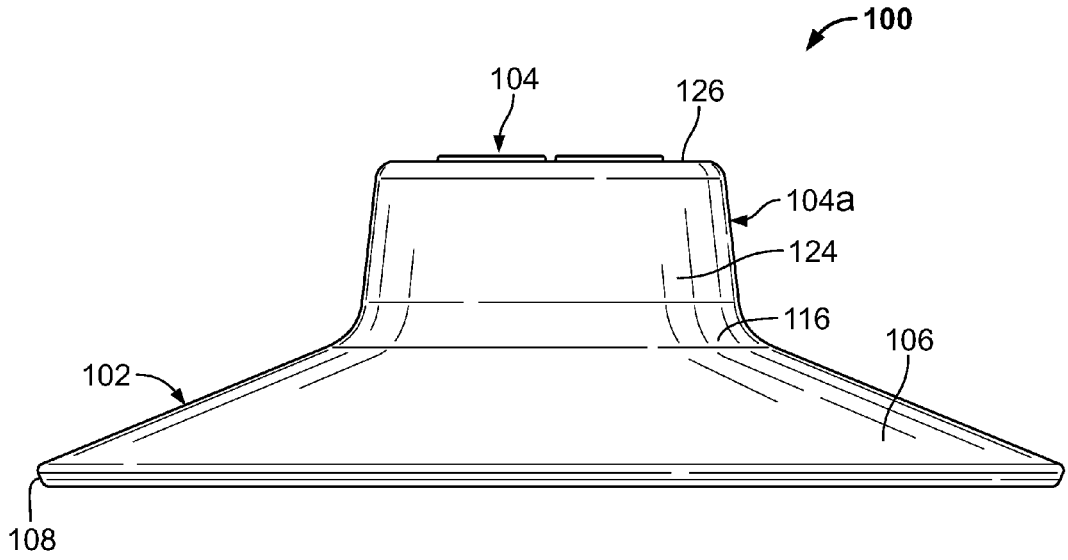
FIG. 5 is a right side elevational view of the teacup cover of FIGS. 1 and 2.
Figure 6:
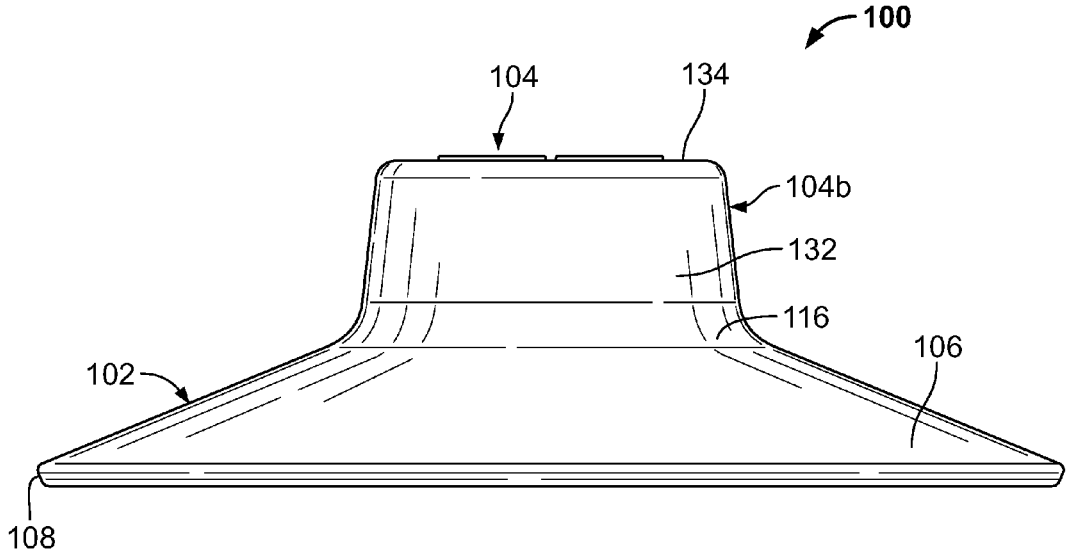
FIG. 6 is a left side elevational view of the teacup cover of FIGS. 1 and 2.
Figure 7:
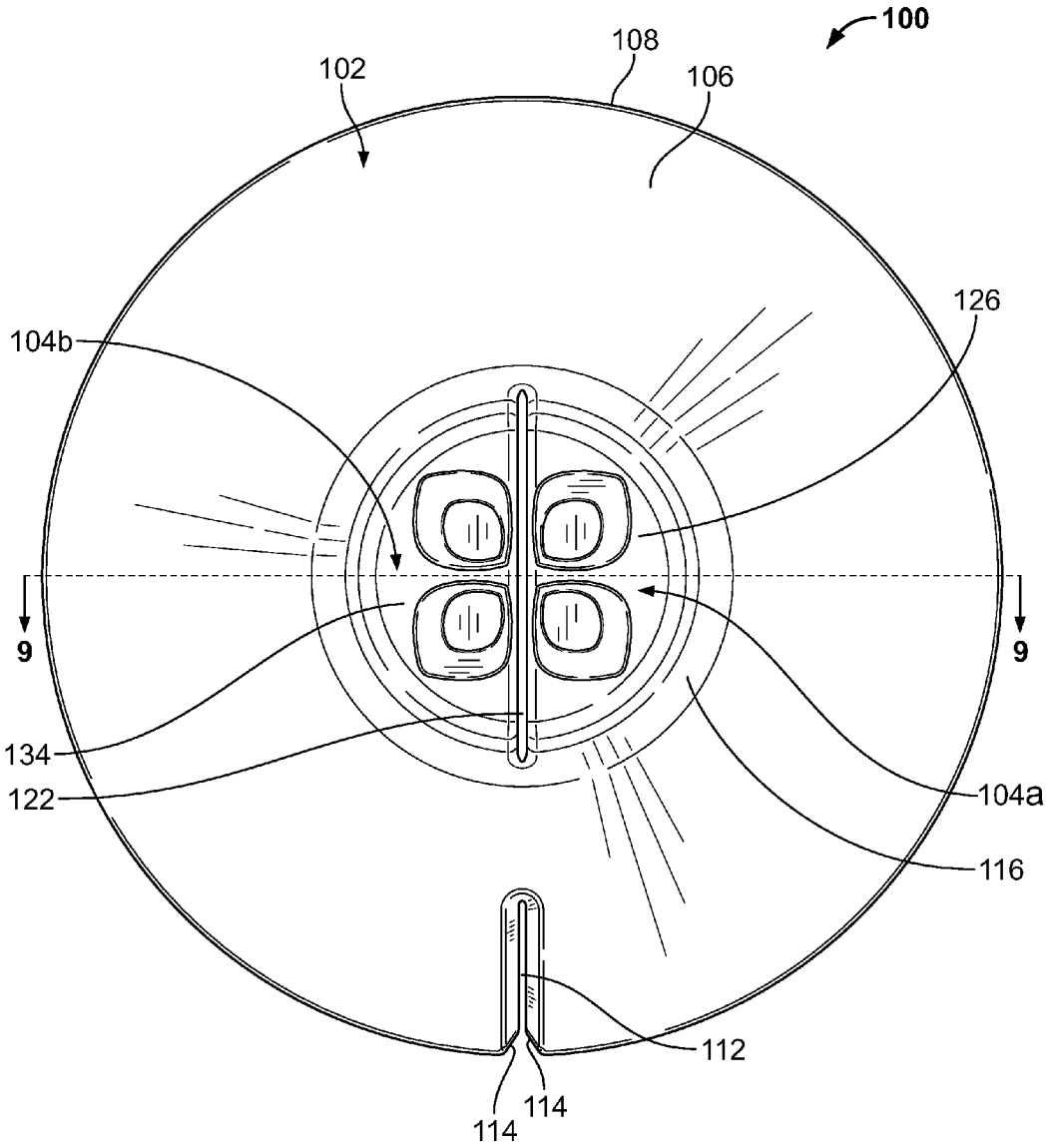
FIG. 7 is a top view of the teacup cover of FIGS. 1 and 2.
Figure 8:
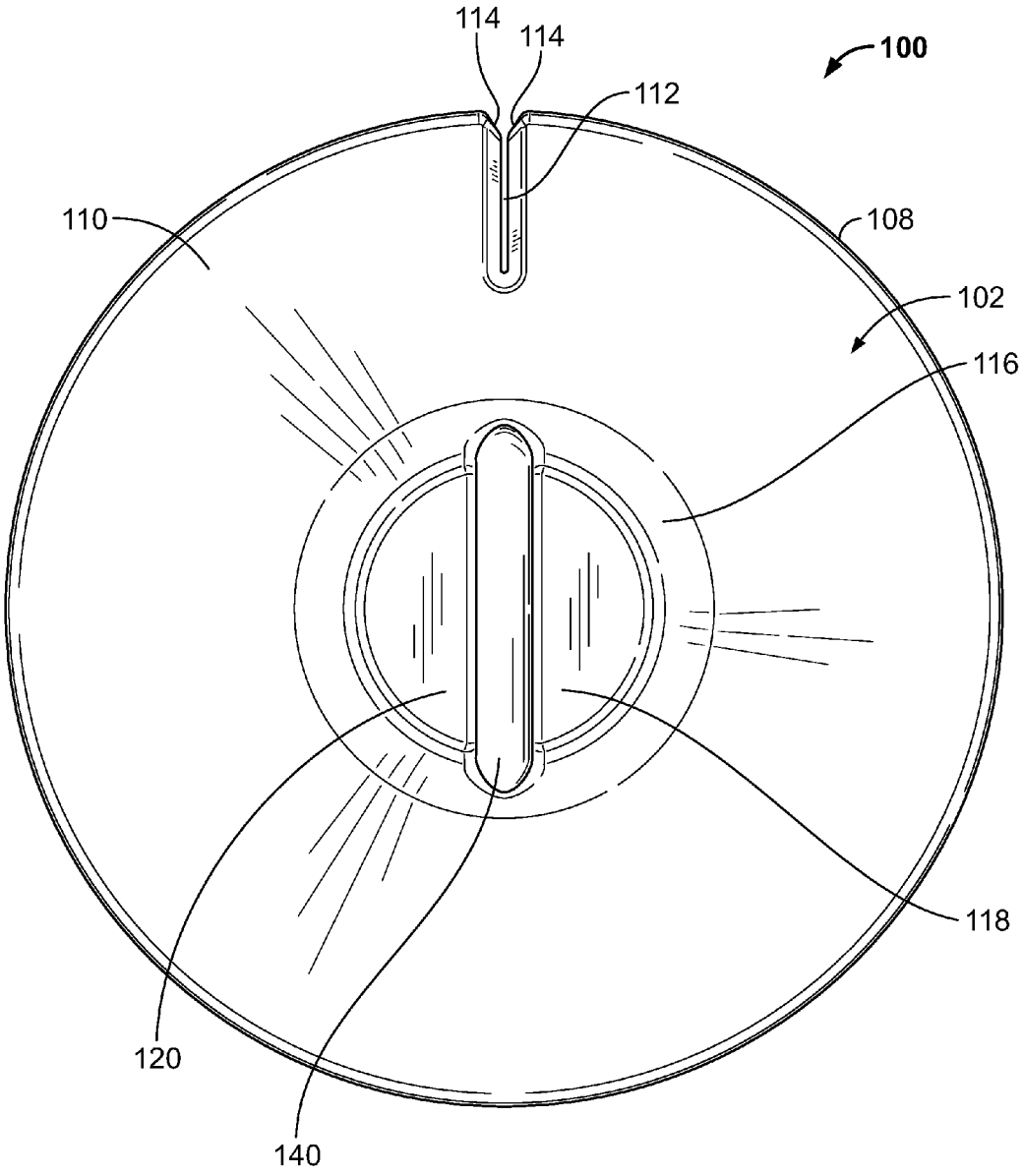
FIG. 8 is a bottom view of the teacup cover of FIGS. 1 and 2.

The first protrusion half 104*a* includes a first radial wall 124, a first top 126, and a first inner wall 128 (see FIG. 2). In the exemplary embodiment, the first radial wall 124 and the first inner wall 128 are connected and form an extruded semicircle. A first end of the extruded semicircle is adjacent and attached to the base 102 by the fillet 116 which integrally forms the first radial wall 124 with the base 102. The distal end of the extruded semicircle, which is away from the base 102, is sealed by the first top 126. In some embodiments, the attachment edges, where the first radial wall 124 is formed with the first inner wall 128, and where the first radial wall 124 and the first inner wall 128 are formed with the first top 126, may be rounded or beveled so as to form a smooth surface.

Figure 9:
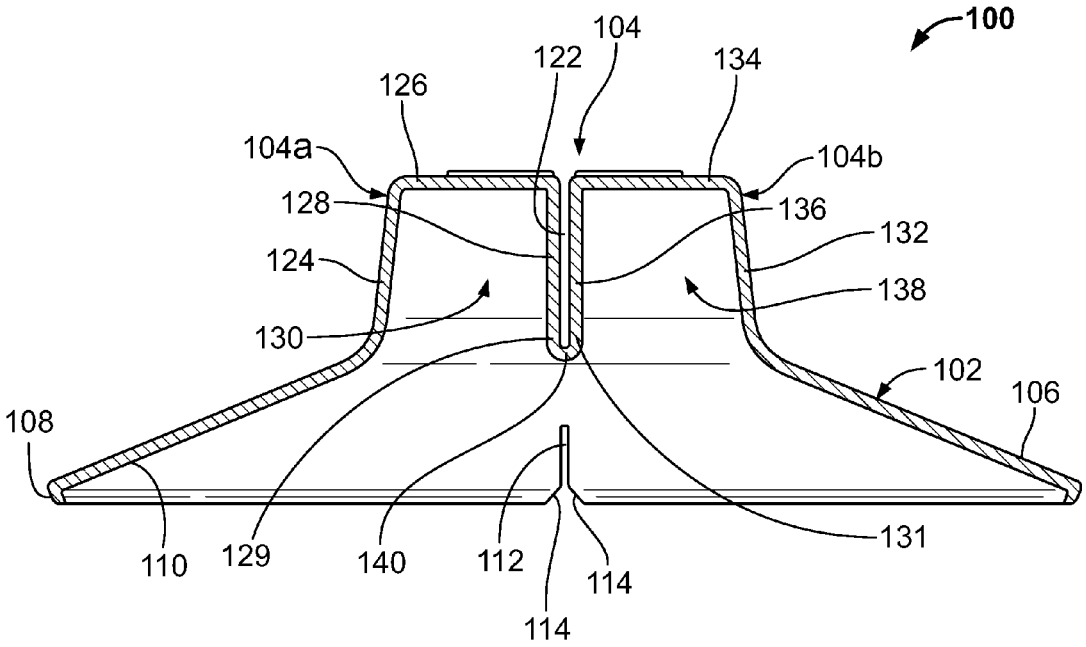
FIG. 9 is a cross-sectional view of the teacup cover of FIGS. 1-8 taken along section line 9-9 of FIG. 7.
Figure 10:
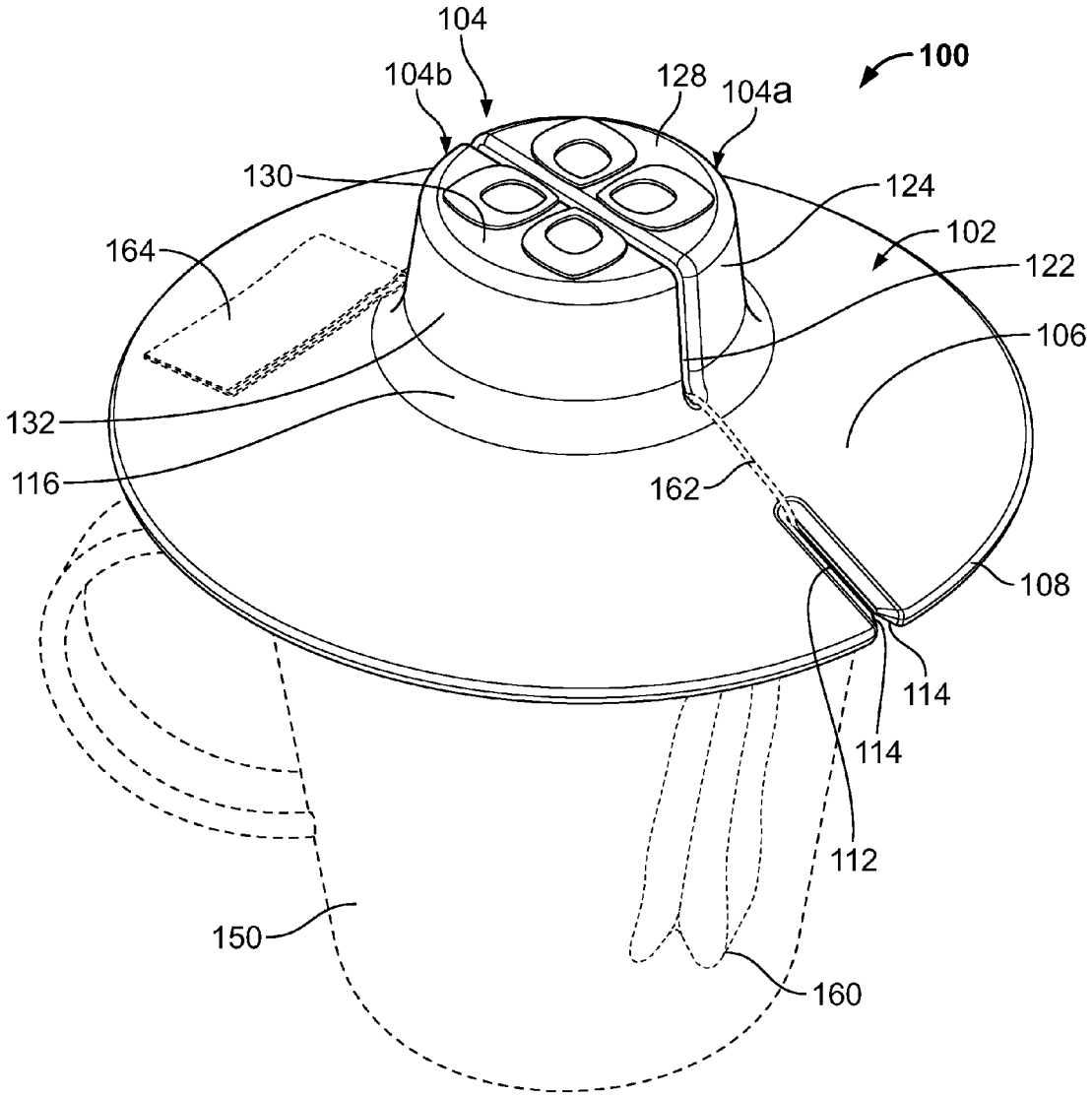
FIG. 10 is a top perspective view of a teacup cover in use with a teacup and teabag.
Figure 11:
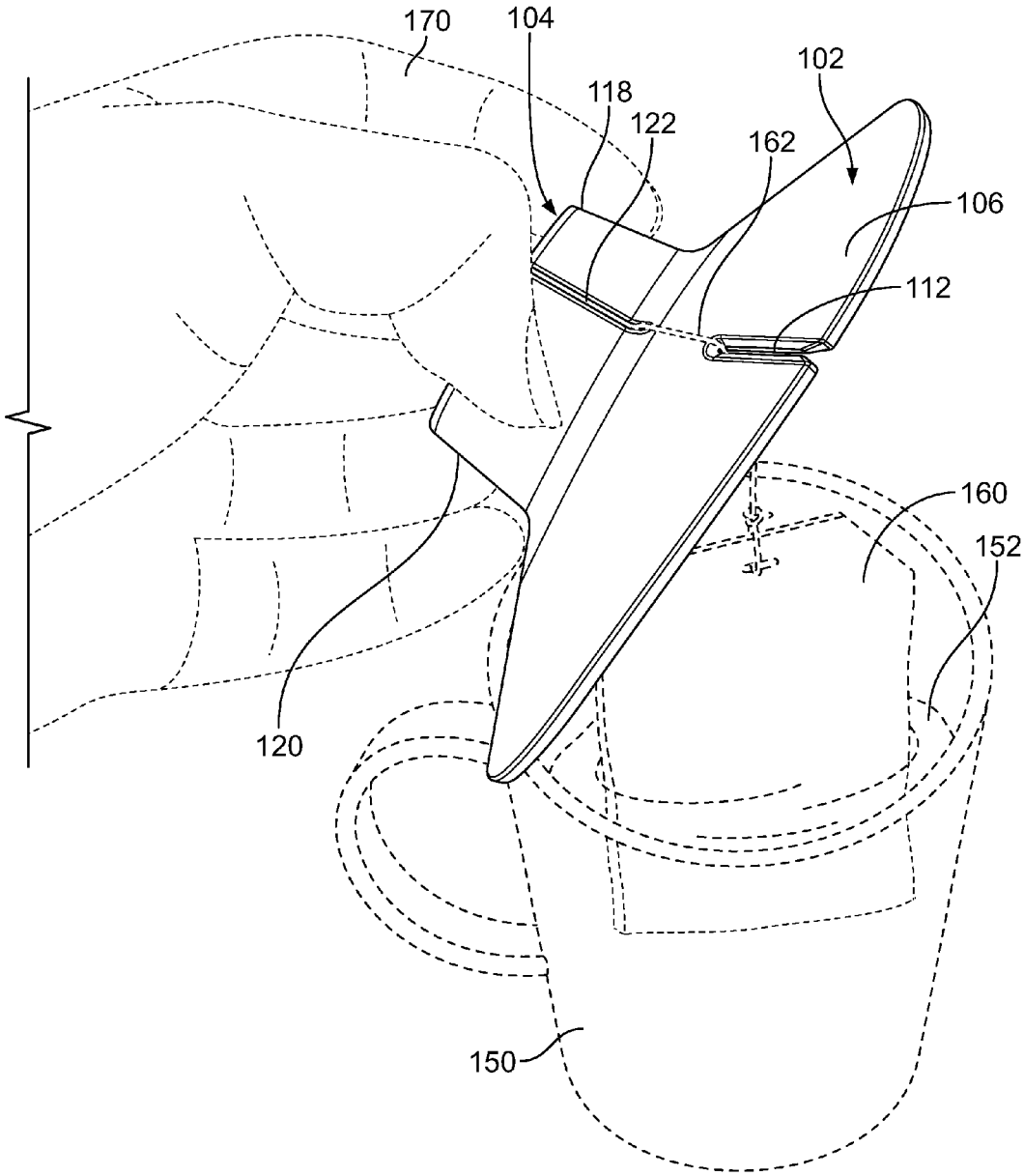
FIG. 11 is a perspective view showing a user removing the teacup cover from a teacup.

The second protrusion half 104*b* includes a second radial wall 132, a second top 134, and a second inner wall 136 (see FIG. 9). In the exemplary embodiment, the second radial wall 132 and the second inner wall 136 are connected and form an extruded semicircle. A first end of the extruded semicircle is adjacent and attached to the base 102 by the fillet 116, which integrally forms the second radial wall 132 with the base 102. The distal end of the extruded semicircle, which is away from the base 102, is sealed by the second top 134. In some embodiments, the attachment edges, where the second radial wall 132 is formed with the second inner wall 136, and where the second radial wall 132 and the second inner wall 136 are formed with the second top 134, may be rounded or beveled so as to form a smooth surface.

It should be recognized by those of ordinary skill in the art that while the first protrusion half 104*a* and the second protrusion half 104*b* are shown, and described, to have a semicircular shape, in other embodiments, they may have varying shapes and/or sizes. For example, there may be any one of a numerous amount of geometric shapes or contoured shapes, all of which would be appropriate and are considered herein. Further, the through-slot 122 of the divided protrusion 104 may be a vertical slot, a horizontal slot, or a slanted slot, or may be in the form of a retaining member such as a recess or a notch.

Referring to FIG. 9, a cross-sectional view of the present invention is shown. The first protrusion half 104*a* and the second protrusion half 104*b* in the exemplary embodiment define, respectively, a first void 130 and a second void 138. Specifically, the first void 130 is defined by the first radial wall 124, the first top 126, and the first inner wall 128, while the second void 138 is defined by the second radial wall 132, the second top 134, and the second inner wall 136. The first void 130 and the second void 138 provide a space for liquid to be retained when the teacup cover 100 is utilized, which is discussed in greater detail below.

The first protrusion half 104*a* and the second protrusion half 104*b* may be solid structures such that no voids are present. In such an arrangement, the sloping walls of the base 102 may define a void which provides a space for liquid to be retained when the teacup cover 100 is utilized.

The first protrusion half 104*a* and the second protrusion half 104*b* are configured to be adjacent such that the first inner wall 128 and the second inner wall 136 are substantially parallel, a first end 129 of the first inner wall 128 and a first end 131 of the second inner wall 136 are connected by a connecting member 140. The connecting member 140 acts to connect the first protrusion half 104*a* with the second protrusion half 104*b*, so as to integrally form a single divided protrusion 104 which is liquid tight and attached to the base 102. The connecting member 140 further provides a location at which the base 102 can bend.

In some embodiments, the teacup cover 100 is monolithically formed from a flexible material such as silicone, which may be achieved through injection molding. However, it should be understood that any other material may be utilized. Such a construction, and material, provide a flexibility to the teacup cover 100 that is advantageous during use. Specifically, the base 102 can be folded and bent at the connecting member 140. This allows a user to squeeze an associated teabag with the teacup cover 100. When the teacup cover 100 is bent, the first protrusion half 104*a* and the second protrusion half 104*b* separate while the connecting member 140 keeps the two halves connected. Another benefit of using silicone is the heat insulating characteristics it possesses. Specifically, an aspect of the present invention is that the teacup cover 100 retains heat within the beverage. Silicone will act to minimize the heat loss of an associated beverage.

Referring to FIGS. 10-14, in use, the teacup cover 100 acts as a holder for a teabag 160 that secures a teabag string 162. First, the teabag 160 is placed in a teacup 150 filled with a liquid to steep the teabag 160. A user 170 then places the teacup cover 100 on top of the teacup 150 and places the teabag string 162 in the radial slit 112 and the through-slot 122, allowing the teabag 160 to remain in the teacup 150 while the teabag string 162 is held in place. The first protrusion half 104*a* and the second protrusion half 104*b* clench the teabag string 162, such that the first inner wall 128 and the second inner wall 136 engage the teabag string 162, restricting the string 162 from falling into the teacup 150 under the weight of the teabag 160. Further, the position of the teabag string 162 can be adjusted within the through-slot 122 and the radial slit 112, allowing the amount of string 162 within the teacup 150 to be adjusted, and subsequently allowing the height of the teabag 160 within the teacup 150 to be adjusted.

Figure 12:
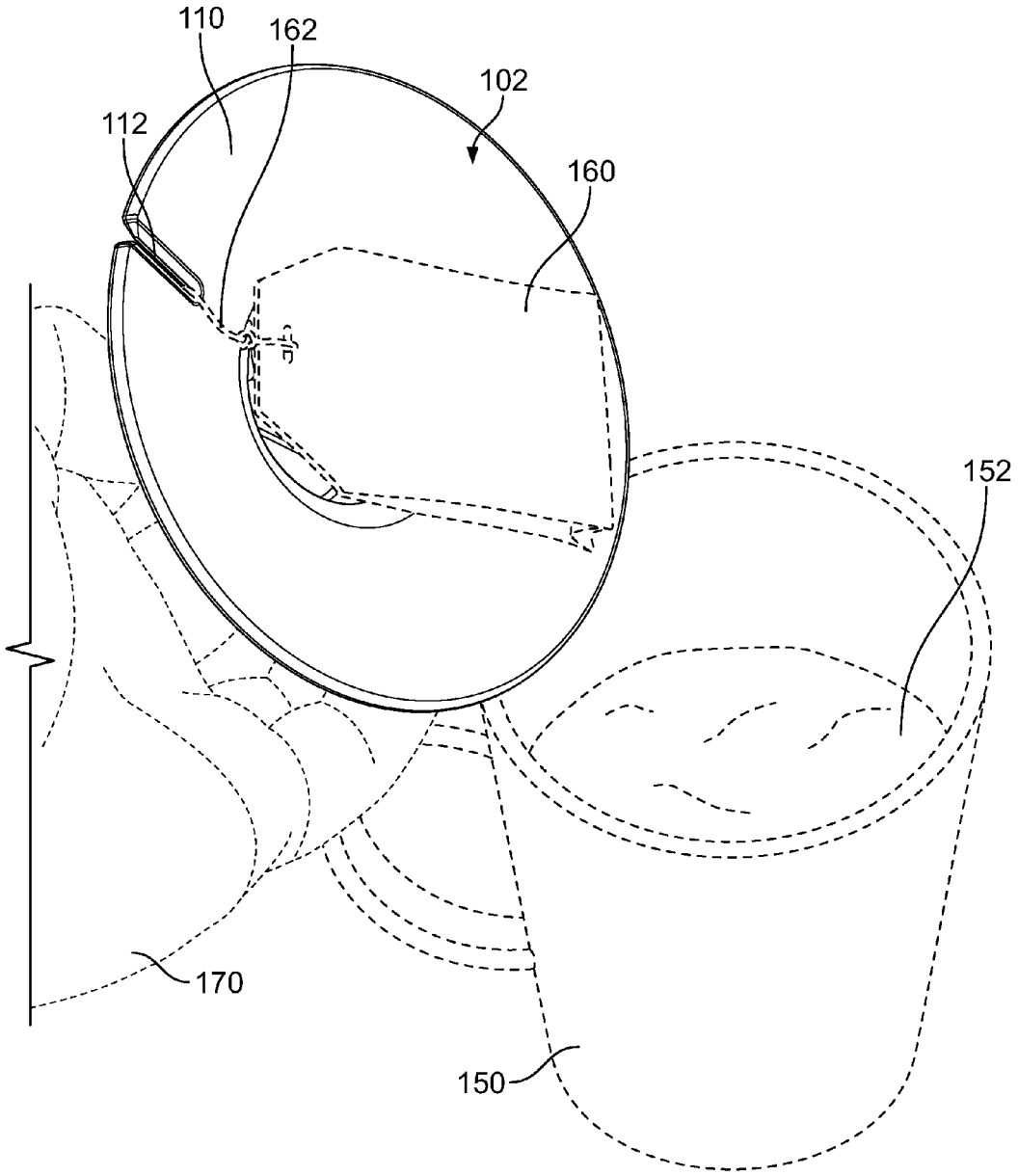
FIG. 12 is a perspective view showing a user removing the teacup cover from a teacup and securing a teabag thereto.
Figure 13:
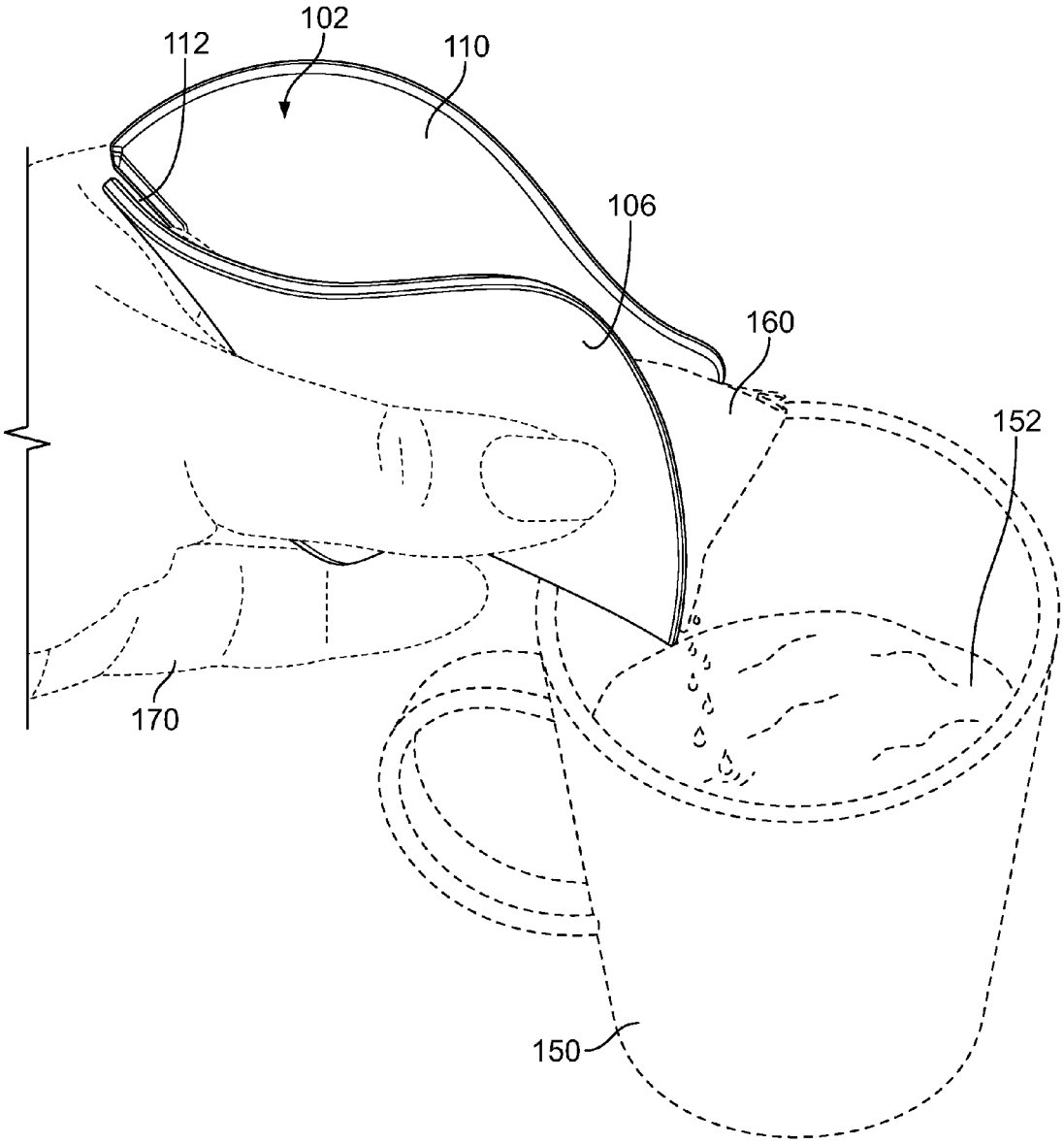
FIG. 13 is a perspective view showing a user squeezing the teacup cover and the associated teabag.
Figure 14:
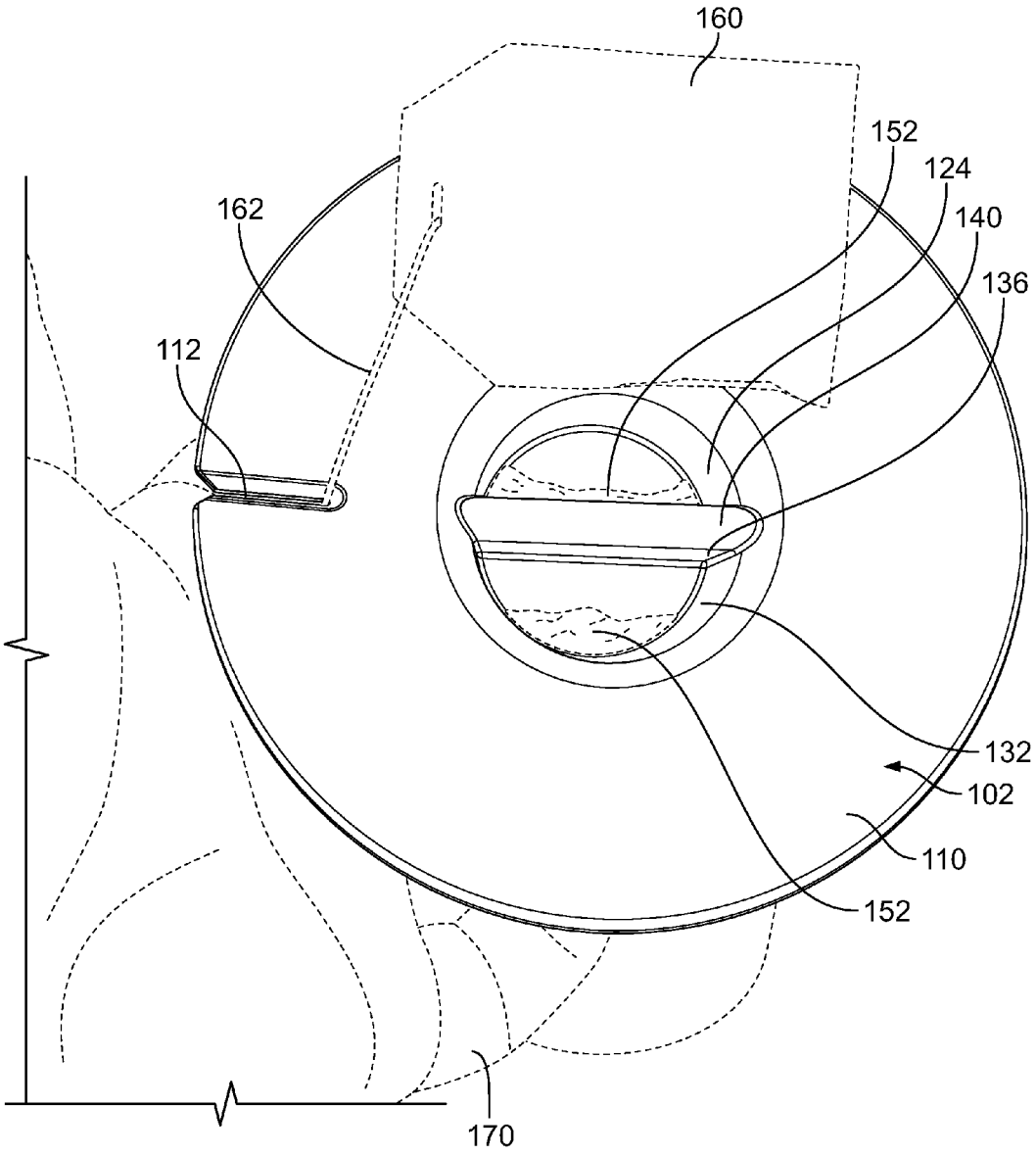
FIG. 14 is a perspective view showing a bottom of the teacup cover after use.

When a user 170 has determined that the teabag 160 has been in the teacup 150 for enough time, the user can remove the teacup cover 100 by first gripping the first protrusion half 104*a* and the second protrusion half 104*b*, and then lifting the teacup cover 100 up. This motion will result in the teabag 160 being lifted with the teacup cover 100, while the teabag 160 is held over the teacup 150 and allowed to drip. The teabag string 162 can then be pulled so that the teabag 160 is held tight to the teacup cover 100. The teacup cover 100 can then be tilted, as shown in FIG. 12, and turned upside down such that the teabag 160 sits on the bottom surface 110 of the base 102, thereby causing any free flowing excess liquid contained in the teabag 160 to run off the teacup cover 100 and into the teacup 150, or into the first void 130 and second void 138 where it is retained. At this point, the user 170 can squeeze the teacup cover 100 such that the base 102 is folded, thus squeezing the teabag 160 and causing any liquid contained in the teabag 160 to run off the teacup cover 100 and into the teacup 150, or into the first void 130 and the second void 138 where it is retained, as shown in FIGS. 13 and 14. The liquid retained in the first void 130 and the second void 138 can then be poured into the teacup 150, or discarded.

At this point, the majority of the liquid 152 has been removed from the teabag 160 and the teabag 160 can be disposed. Due to the shape of the teabag cover 100, the teabag 160 can be held therein and any remaining liquid 152 will be caught in the first void 130 and the second void 138 while the teabag 160 is transported to a garbage. Thus, no liquid 152 is spilled or dripped during disposal of the teabag 160.

It will be understood that the embodiments of the present invention described herein are merely exemplary and that a person skilled in the art may make many variations and modifications without departing from the spirit and the scope of the invention. For example, the present invention could include any retaining mechanism to hold the string in place. All such variations and modifications, including those discussed above, are intended to be included within the scope of the invention as defined by the appended claims.

What is claimed is:

1. A cup cover, comprising:

a frusto-conical base having a generally circular shape designed to cover a teacup, and having a slit extending from an outer edge thereof; and a handle protrusion extending from a center of an upper surface of the frusto-conical base, the handle protrusion comprising two protrusion halves, each protrusion half having a generally semi-circular cross-section, and the two protrusion halves defining a central through-slot therebetween extending across the handle protrusion;

wherein the frusto-conical base and the handle protrusion are formed in one piece of a flexible material, wherein the cup cover can suspend a tea bag therefrom, a user threading a string attached to the teabag through the slit in the frusto-conical base and through the through-slot in the handle protrusion, and wherein after brewing tea in the cup with the tea bag suspended from the cup cover, the user can grasp the handle protrusion to lift the cover, the semi-circular protrusion halves flexing to grip the teabag string threaded through the through-slot to allow lifting of the teabag.

2. The cup cover of claim 1, wherein the first half defines a first void and the second half defines a second void.

3. The cup cover of claim 2, wherein the first void and the second void are configured to retain a liquid.

4. The cup cover of claim 1, wherein the slit extends toward a center of the base.

5. The cup cover of claim 1, wherein the protrusion is a handle.

6. The cup cover of claim 1, wherein the cup cover is formed of silicone.

7. The cup cover of claim 1, wherein the base is formed through injection molding.

8. A cup cover, comprising:

a base having a slit extending from an edge of the base toward a center of the base; and a flexible handle protrusion extending upwardly from the base and including a through-slot extending partially into the protrusion to separate a first portion of the protrusion from a second portion of the protrusion;

wherein the slit is configured to receive a string of a teabag, wherein the through-slot is configured to receive the string, wherein grasping of the flexible handle protrusion causes the first portion and the second portion to grip the teabag string threaded through the through-slot to allow lifting of the teabag, and the protrusion defining a void sized to retain excess liquid from the teabag.

9. The cup cover of claim 8, wherein the first portion includes a first radial wall, a first inner wall, and a first top, and the second portion includes a second radial wall, a second inner wall, and a second top.

10. The cup cover of claim 9, wherein the first inner wall and the second inner wall are substantially parallel.

11. The cup cover of claim 8, wherein the first portion defines a first void and the second portion defines a second void.

12. The cup cover of claim 11, wherein the first void and the second void are configured to retain a liquid.

13. The cup cover of claim 8, wherein the base, the first portion, and the second portion are integrally formed.

14. The cup cover of claim 8, wherein the base has a first end along the edge and a second end along the edge, the second end opposite the first end, the base being flexible to allow the first end to contact the second end.

15. The cup cover of claim 14, wherein the base is substantially circular in shape.

* * * * *